US005979119A

United States Patent [19]

Trafton

[11] Patent Number: 5,979,119

[45] Date of Patent: Nov. 9, 1999

[54] COMPONENTS AND ASSEMBLIES FOR BUILDING CONSTRUCTION AND METHODS OF MAKING AND USING SAME

[76] Inventor: Ronald H. Trafton, 3910 Briarcrest, San Antonio, Tex. 78247

[21] Appl. No.: 08/624,023

[22] Filed: Mar. 27, 1996

[51] Int. Cl.[6] ..... E04C 3/30

[52] U.S. Cl. ..... 52/40; 52/726.1; 52/730.4; 52/730.5; 52/731.4; 52/731.3; 52/732.2; 52/732.3; 52/736.1; 52/736.3; 52/738.1

[58] Field of Search ..... 52/730.1, 730.4, 52/730.5, 731.1–731.5, 731.9, 732.1, 733.2, 733.3, 732.3, 732.2, 761, 781, 720.1, 726.1–726.3, 40, 736.1, 736.3, 738.1, 282.1–282.5; 256/DIG. 5; 248/125.1, 219.3, 223.41

[56] References Cited

U.S. PATENT DOCUMENTS

| | | | |
|---|---|---|---|
| 2,166,098 | 7/1939 | Kotraby | 52/731.5 X |
| 3,462,110 | 8/1969 | Cheslock | 52/738 |
| 4,142,343 | 3/1979 | Trafton | 52/721 |
| 4,194,338 | 3/1980 | Trafton | 52/721 |
| 4,493,172 | 1/1985 | Jones | 52/282.2 X |
| 4,941,763 | 7/1990 | Euteneuer | 403/3 |
| 5,175,971 | 1/1993 | McCombs | 52/40 X |
| 5,474,501 | 12/1995 | Teng | 52/726.3 X |

FOREIGN PATENT DOCUMENTS

| | | | |
|---|---|---|---|
| 303130 A1 | 2/1989 | European Pat. Off. | 52/720.1 |
| 2019367 | 11/1971 | Germany | 403/381 |

*Primary Examiner*—Robert Canfield
*Attorney, Agent, or Firm*—Kammer & Huff, PLLC

[57] ABSTRACT

An assembly of structural building components for use in conjunction with an improved anodized aluminum post having a generally cylindrical cross section and longitudinal grooves disposed in a peripheral wall therein for the receipt of the various components. The improved aluminum post has a double wall extruded construction to increase rigidity and versatility. The component assemblies include improved bracket structures insertable into the longitudinal grooves, double bracket structures, improved post connectors for joining one post to another at various angles, terminal post clamps and caps, and various utility structures adapted specifically for use in conjunction with the improved post design.

16 Claims, 7 Drawing Sheets

COMPONENTS AND ASSEMBLIES FOR BUILDING CONSTRUCTION AND METHODS OF MAKING AND USING SAME

BACKGROUND OF THE INVENTION

1. Field of the Invention

The present invention relates generally to construction components for buildings and to methods of constructing and utilizing such construction components. The present invention relates more specifically to improvements and additional components for a system of extruded aluminum post construction. The basic post structure of the present invention has a tubular configuration with a substantially constant wall thickness and a number of longitudinal grooves arranged on its outer periphery. Each groove has an arcuate wall portion and an intersecting, substantially flat wall portion adapted to retain a variety of brackets, adapters and interconnecting components for mounting the posts and connecting one to another.

2. Description of the Related Art

In general, posts and support assemblies in the past for such constructed objects as privacy fences, boat docks, cyclone fencing, highway signs, storage sheds, buildings, homes, warehouses and the like have utilized various devices that are cumbersome and require frequent maintenance and replacement. It has been recognized that metallic posts and other building construction components alleviate some of the wear and deteriorating properties of wooden posts and the like. Special attachments and hardware requirements for such metallic construction elements have slowed the use of such primary posts and beam components in the applications mentioned above.

Various attempts to solve or rectify the problems associated with connecting, mounting and utilizing metallic posts and cross-beams have mostly proven unsuccessful. The most significant prior art attempts to utilize such metallic building components are exemplified by applicant's prior issued U.S. Pat. No. 4,142,343, issued Mar. 6, 1979, entitled "Post Apparatus and Methods of Constructing and Utilizing Same", and U.S. Pat. No. 4,194,338, issued Mar. 25, 1980, entitled "Construction Components, Assemblies Thereof, and Methods of Making and Using Same."

The two issued patents identified above describe the basic components for a metallic post based building system upon which the present invention improves. Since the issuance of the above referenced patents, others have attempted to base improvements on the fundamental design disclosed in the patents, but with little success.

Among the more significant efforts to improve upon the basic metallic post building system concept are the following patents. U.S. Pat. No. 5,003,741, issued Yeh on Apr. 2, 1991, entitled "Structure of Multi-Function Frame Members", utilizes an octagonal tube with an interior square cross-section. A multi-legged orthogonally structured connector is utilized to attach one octagonal tube to another.

U.S. Pat. No. 4,577,449, issued Celli on Mar. 25, 1986, entitled "Prefabricated Structural Connector for Steel Frame Building", describes a rectangular tube structure designed to fit around a standard cylindrical post and to retain a number of plates at orthogonal positions about the tube. The connector attaches to the post and is fixed in position by an arrangement of set screws.

U.S. Pat. No. 4,461,596, issued to Davidson on Jul. 24, 1984, entitled "Arrangement for Frame and the Like", describes tubular struts much in the nature of the Yeh patent identified above. Two piece connector devices are used to attach one tubular strut to another.

U.S. Pat. No. 4,583,359, issued to Staeger on Apr. 22, 1986, entitled "Profile Tubes for the Production of Readily Assembled and Dismantled Structures" describes a variety of tubular posts with star-shaped cross-sections and a clamping connector designed to attach the end of one such tube to the side of another.

The present invention is an array of structural improvements to assembly and system components and the addition of new system components that improves upon the basic structure and function of the earlier issued patents.

SUMMARY OF THE INVENTION

It is, therefore, an object of the present invention to provide an improved anodized aluminum post structure that is light-weight, rigid, easy to manufacture and versatile in its applicability to the construction of buildings, signs, posts, fences, frames and the like.

It is another object of the present invention to provide an improved array of brackets, adapters, and interconnecting components for mounting to the improved post design and for facilitating the attaching of post to post and wall sections to post frames. It is another object of the present invention to provide an extruded tubular aluminum post support member having a double-wall cross-section with each wall having a substantially constant wall thickness to form a post with improved rigidity and versatility.

It is another object of the present invention to provide an improved aluminum post support structure that is of simple construction and pleasing in appearance and which is suitable for both interior construction and exterior construction.

It is another object of the present invention to provide an aluminum post support system with brackets adapters and interconnecting components that attach to the metallic post support member without the necessity of deforming either the post or the brackets, adapters, or interconnecting components, and without the necessity of any bolts protruding into any part of the post.

Accordingly, the present invention provides an assembly of structural building components for use in conjunction with an improved anodized aluminum post having a generally cylindrical cross section and longitudinal grooves disposed therein for the receipt of the various components. The improved aluminum post has a double wall extruded construction to increase rigidity and versatility. The component assemblies include improved bracket structures insertable into the longitudinal grooves, double bracket structures, improved post connectors for joining one post to another at various angles, terminal post clamps and caps, and various utility structures adapted specifically for use in conjunction with the improved post design.

The foregoing and other objects and advantages of the present invention will become apparent from the following disclosure describing several preferred embodiments of the invention in detail and illustrated in the appended drawings. It is anticipated that minor variations in the structural features and arrangement of parts in the devices described may occur to those skilled in the art without departing from the spirit of the invention and without sacrificing any of the advantages or objects of the present invention.

DESCRIPTION OF THE PREFERRED EMBODIMENT

Figure 1:
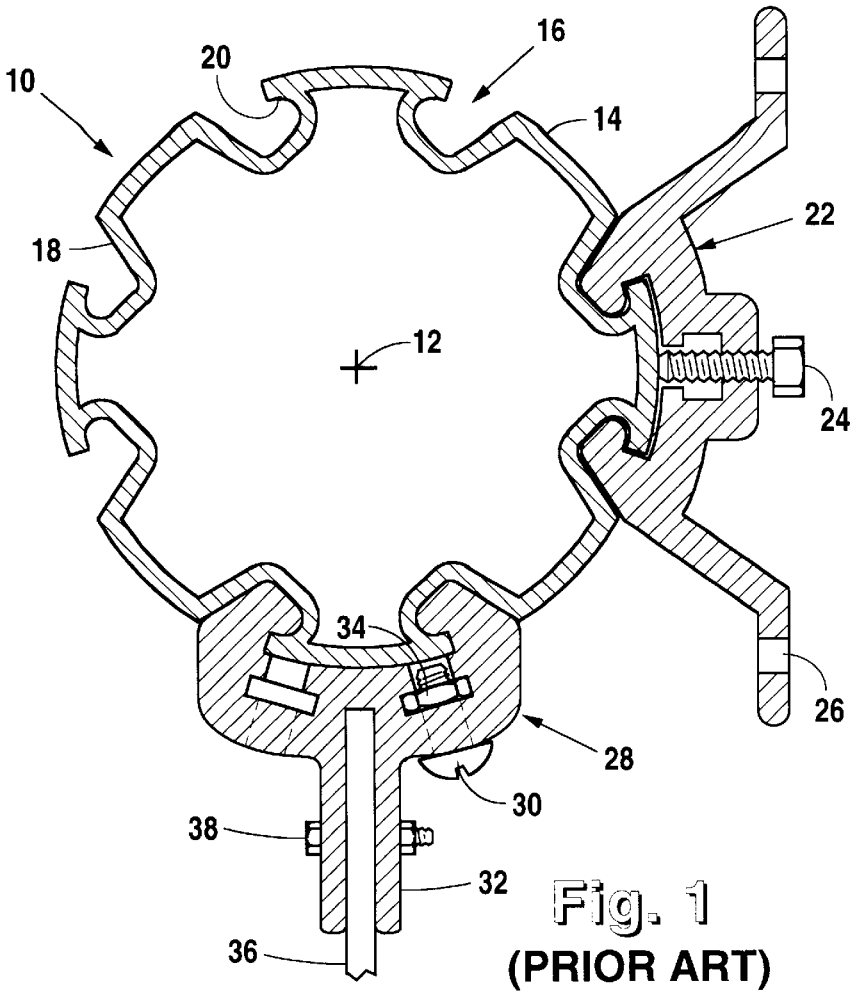
Fig. 1 (PRIOR ART)
FIG. 1 discloses a cross-sectional view of a prior art assembly of construction components.

Reference is made first to FIG. 1 for a brief description of the prior art that forms the basis for the improved structures of the present invention.

FIG. 1 discloses in cross-section an assembly of a prior art tubular support member with two different prior art bracket members attached. FIG. 1 shows in cross-section an elongated tubular support member (10) having a major longitudinal central axis (12) and being generally cylindrical in shape with a regularly varying radius projected from central axis (12). Tubular support member (10) has an average radius based upon the distance between central axis (12) in primary peripheral wall (14).

Positioned within peripheral wall (14) at a number of radial positions are grooves (16). In this early embodiment, grooves (16) were of one of two mirror image configurations. In each case, grooves (16) incorporated side walls (18) and an arcuate wall section (20). The combination of side walls (18) and arcuate wall section (20) provided a means for gripping attachment to the tubular member (10) by the associated brackets, attachments and the like.

A first example of an attachable bracket (22) is shown in position on support member (10). The purpose of bracket (22) was to provide a flat projecting attachment surface for wall sections, plates and the like. Bracket (22) was slid onto support member (10) from one end of support member (10) by engagement of two opposing grooves (16). Once slid into position, bracket (22) was fixed in place on support member (10) by tightening bolt (24). As indicated, bracket (22) provides two projecting flat surfaces with mounting holes (26) for the attachment of plates, wall sections and the like.

Bracket (28) is a two-piece bracket comprised of mirror image sections that may be attached to support member (10), again by way of grooves (16), but without the necessity of sliding into grooves (16) from the top or bottom of tubular member (10). Bracket (28) is attached in two pieces with each piece being insertable into an opposing groove (16). Once each piece of bracket (28) is positioned, plate sections (32) may be compressed together by bolt (38), typically with a plate section (36) interspaced between, so as to draw bracket (28) together and position it on support member (10). Screw (30) and bolt (34) provide an additional means for securing bracket (28) into position on support member (10).

Figure 2:
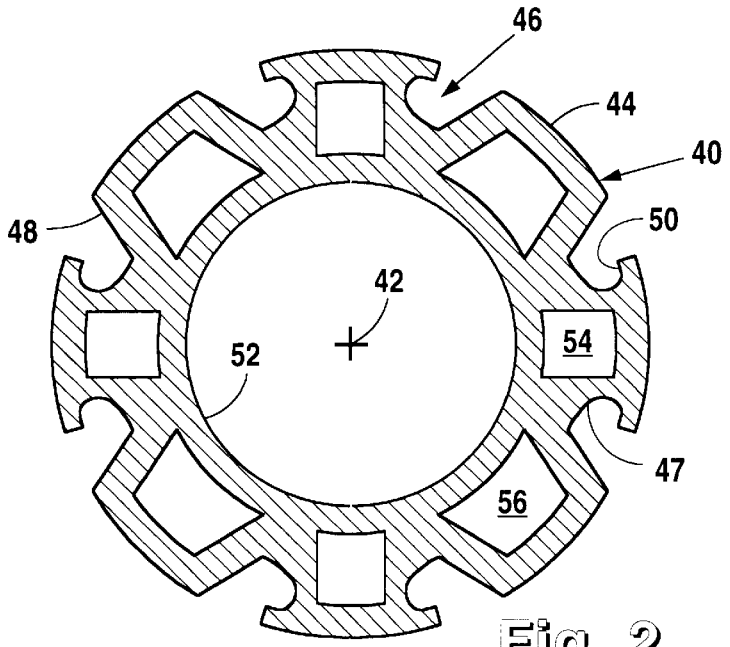
FIG. 2 discloses a cross-sectional view of the improved longitudinal post support member of the present invention.

Reference is now made to FIG. 2 for a detailed description of the improved structural design of the tubular support member of the present invention. Support member (40), shown in FIG. 2, has a peripheral structure essentially the same as that shown in FIG. 1. A primary wall (44) extends at a generally fixed radius from a major longitudinal central axis (42). Likewise, grooves (46) are comprised of side walls (48) flat base walls (47) and arcuate walls (50) in a manner that permits attachment of brackets and the like.

Distinct from the cross-section in FIG. 1, however, is the additional interior cylindrical wall (52) that improves the rigidity and versatility of the device. Whereas use of the support member (10) shown in FIG. 1 had included the insertion of various geometrically shaped connectors and the like into the interior cross-section of the support member, it has been found that exterior connectors and attachments provide a more suitable means for assembling the components of the present invention. Therefore, in lieu of providing a mechanism for inserting connectors into the interior space of the support member, it is possible to improve the rigidity and versatility of support member (40) by adding the interior cylindrical wall (52) as shown. The result is an extruded aluminum tubular component with the same peripheral groove structure and an interior cylindrical structure suitable for conduit-type applications. In addition, smaller, generally rectangular conduit sections (54) and (56) are created by the addition of interior cylindrical wall (52).

Figure 3A:
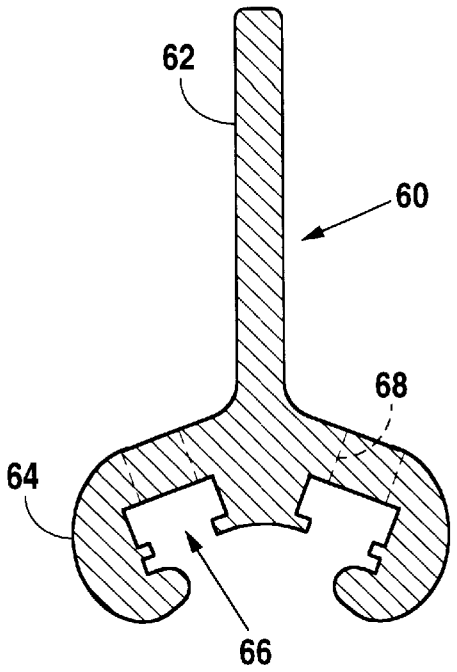
FIG. 3A discloses a cross-sectional view of the improved single plate bracket of the present invention.
Figure 3B:
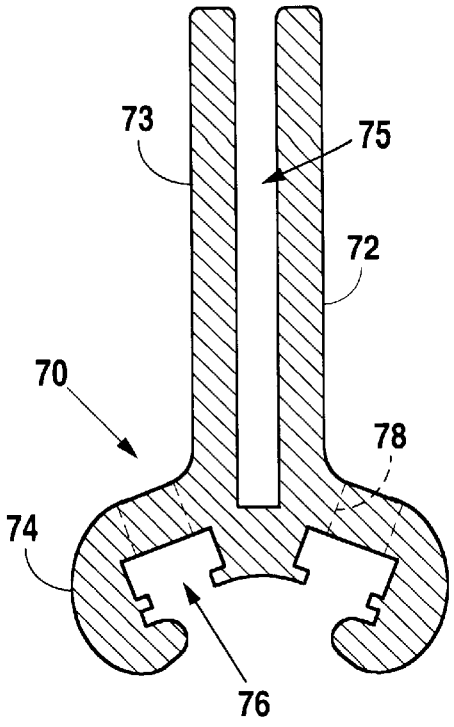
FIG. 3B discloses a cross-sectional view of the improved double plate bracket of the present invention.
Figure 3C:
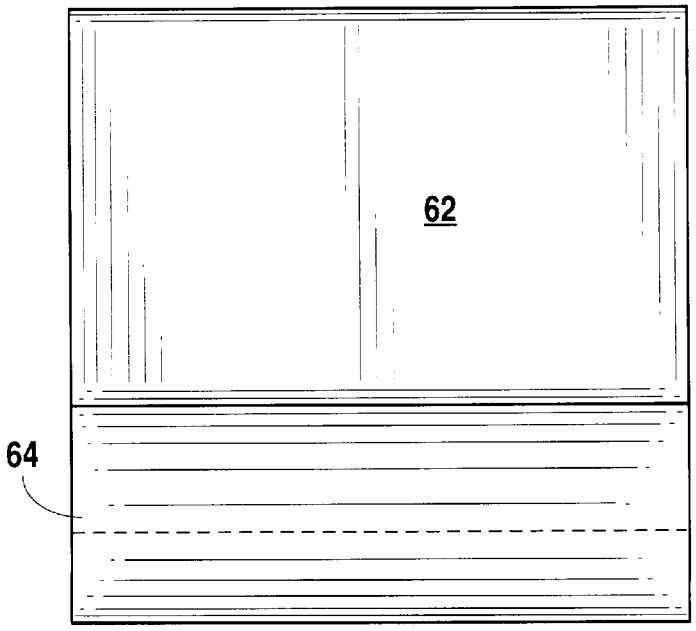
FIG. 3C discloses a side view of the improved single plate bracket of the present invention.

Reference is now made to FIGS. 3A–3C for a detailed description of improved brackets suitable for attachment to the support member described in FIG. 2. FIG. 3A discloses a cross-sectional view of the improved single-plate bracket of the present invention. Unlike the two-piece bracket described above in conjunction with the prior art shown in FIG. 1, FIG. 3A shows a one-piece, single-plate bracket suitable for attachment to a pair of opposing grooves on the support member of the present invention. Single-plate bracket (60) incorporates plate section (62) and two opposing groove inserts (64). Single-plate bracket (60) requires attachment to the pair of opposing grooves (64) at one end of the tubular support member. Positioning single-plate bracket (60) on the tubular support member involves the use of a bolt positioned in bolt slot (66) and the attachment of a threaded screw through aperture (68) in a manner that is shown and described in FIG. 1.

Plate section (62) provides a flat planer surface for the attachment of a variety of wall sections, connectors, T-shaped attachments, L-shaped attachments (as described below), and a host of other types of building and sign construction components.

FIG. 3B shows a similarly constructed bracket with a double-plate design still of single piece construction. Double-plate bracket (70) is comprised of first plate section (72) and second plate section (73) separate by insert slot (75). Attachment to the grooves and the tubular support member is again made by way of groove inserts (74).

Positioning on the tubular support member is again accomplished by way of bolt slot (76) and apertures (78). As with the single plate bracket shown in FIG. 3A, double-plate bracket (70) shown in FIG. 3B is capable of connecting a variety of plates, walls, signs, sections, etc., to the tubular support member.

FIG. 3C discloses what is essentially either of the brackets shown in FIGS. 3A and 3B from the side, showing the flat plate area (62) appropriate for attachment of a variety of components and the groove insert section (64). The side view of the bracket (60), shown in FIG. 3C, is representative only of the types of brackets that could be constructed with the cross-sections described in FIGS. 3A and 3B. The length of such a bracket could be any length up to the entire length of the tubular support member and could be of a width appropriate for any type of surface connection.

Figure 4A:
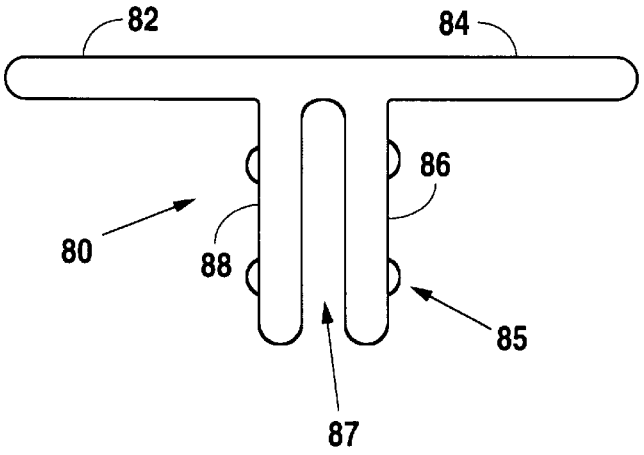
FIG. 4A discloses a cross-sectional view of a T-plate connector member of the present invention.
Figure 4B:
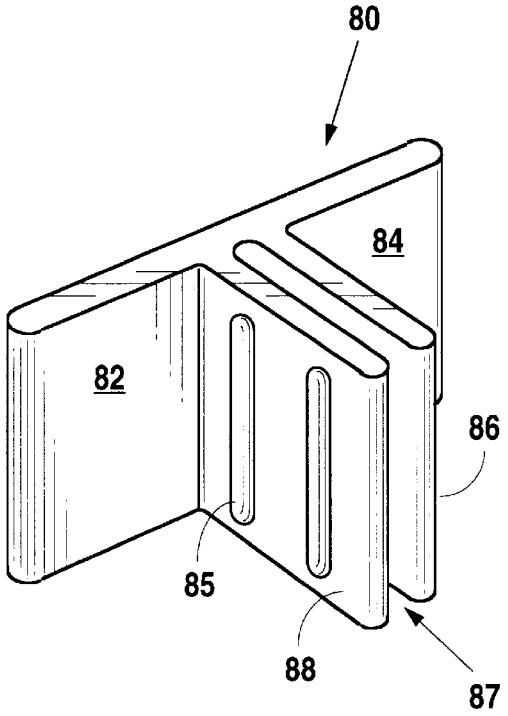
FIG. 4B discloses a perspective view of the T-plate member of the present invention.

Reference is now made to FIGS. 4A and 4B, and FIGS. 5A and 5B for a detailed description of two types of connectors typically used in conjunction with the brackets and tubular support members described above. FIGS. 4A and 4B show a T-shaped connector appropriate for attachment to either the bracket described in FIG. 3A, or the double-plate bracket described in FIG. 3B. T-shaped member (80) comprises two single-plate sections (82) and (84) and a single double-plate section made up of arms (86) and (88). A slot (87) is defined between arms (86) and (88). Ridges (85) provide gripping surfaces for the attachment of various other building components. FIG. 4B discloses in perspective view the structure of a typical T-shaped attachment clip or connector.

The attachment of the connectors shown in FIGS. 4A and 4B to plates to the single and double-plate bracket, shown in FIGS. 3A and 3B, is made by way of insertion of plate section (62) into slot (87), or by way of the insertion of plate sections (82) or (84) into slot (75). In this manner, a variety of connections, attachments and bracket arrangements can be configured in association with the tubular support member.

Figure 5A:
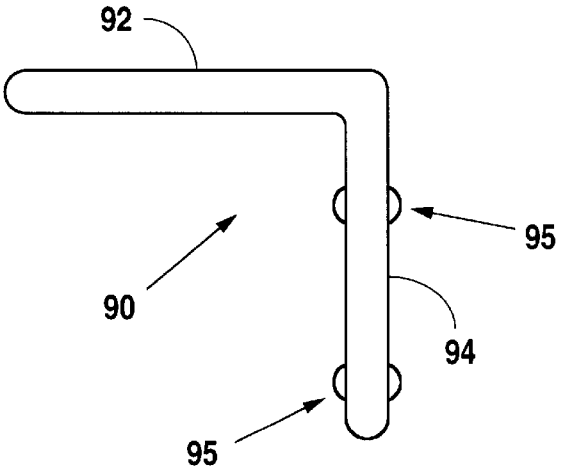
FIG. 5A discloses a cross-sectional view of the L-shaped plate connector member of the present invention.
Figure 5B:
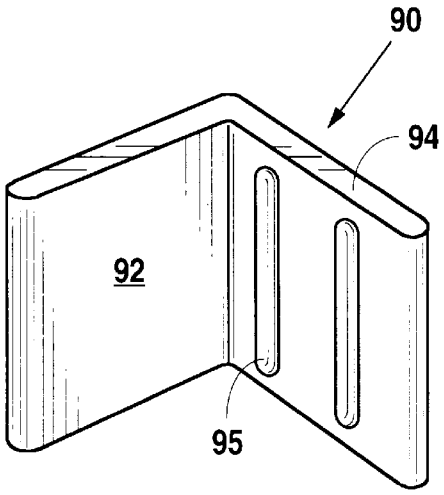
FIG. 5B discloses a perspective view of the L-shaped plate member of the present invention.

In FIGS. 5A and 5B, a similarly structured L-shaped connector device (90) is shown having a single first wall (92) and a single second wall (94). Ridges (95) again provide appropriate attachment surfaces.

Figure 6:
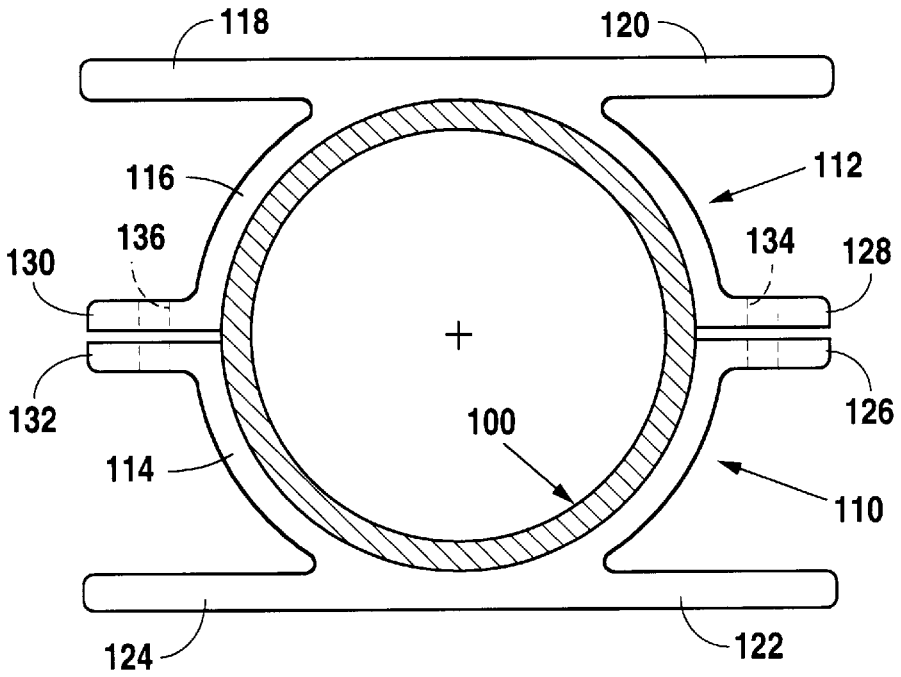
FIG. 6 discloses a cross-sectional view of a two-piece parallel casting clamp of the present invention.
Figure 7:
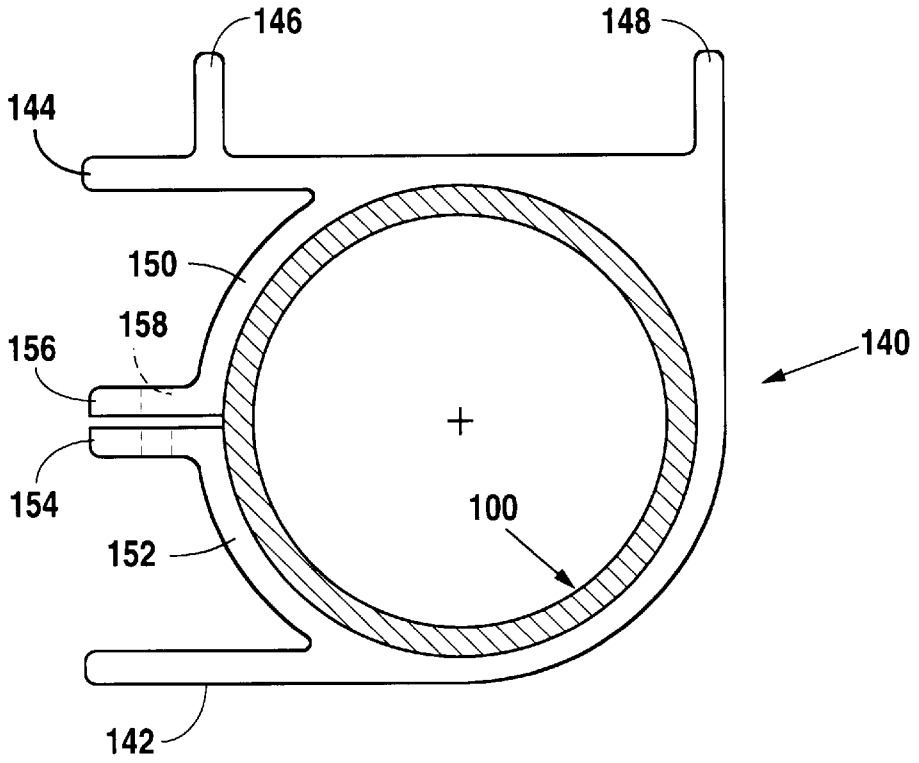
FIG. 7 discloses a cross-sectional view of the one-piece corner casting clamp of the present invention.

Reference is now made to FIGS. 6 and 7 for cross-sectional views of two casting clamps appropriate for use in association with the improved tubular support member described above. It is noted once again that the improvements in the present invention are, in some respect, direct towards use of the tubular support member by way of attachment to and clamping on the exterior peripheral surface of the support member rather than insertion into an positioning within an interior circumference of the support member. The casting clamps shown in FIGS. 6 and 7 continue this general improvement approach. FIG. 6 discloses a two-piece parallel casting clamp attachable around the outer periphery of the tubular support member shown generally as (100) in FIG. 6. The two-piece parallel casting clamp of the present invention, shown in FIG. 6, is comprised of identical clamping components (110) and (112). Clamping components (110) and (112) fit opposite each other about the cylindrical structure of the tubular support member (100) and are sized so as to be slightly smaller in circumference than tubular support member (100). This allows a gap to exist between clamping components (110) and (112) sufficient to permit their tight attachment to tubular support member (100). Casting clamp components (110) and (112) are structurally designed to provide flat attachment arms (118), (120), (122) and (124). Casting clamp components (110) and (112) would typically be used where wall section or other flat plate structures are attachable to a tubular support member (100) in, for example, a wall section of a building, or a post section for a sign. Component (110) and (112) are attached one to another by way of clamping plates (126), (128), (130) and (132). Appropriate bolts are placed through apertures (134) and (136) to draw plate (126) and (128) together and to draw plates (130) and (132) together. In this way, circumferential walls (114) and (116) are tightly adhered to the peripheral wall of tubular support member (100).

FIG. 7 discloses a corner casting clamp similar in configuration to the parallel casting clamp shown in FIGS. 6. In this case, however, corner casting clamp (140) is of single piece construction and must be slid over one end of tubular support member (100). Once positioned, corner casting clamp (140) is held in place by insertion of an appropriate bolt through apertures (158) so as to draw bolt plates (154) and (156) together, thereby drawing circumferential walls (150) and (152) tightly against the peripheral wall of tubular support member (100).

Once in place, corner casting clamp provides flat plate-like surfaces (142) and (148) to an exterior area of tubular support member (100) and plates (144) and (146) to an interior orthogonally arranged area of tubular support member (100). Here again, the structure is appropriate for presenting attachment means for corner walls on both an interior and exterior surface.

Figure 8:
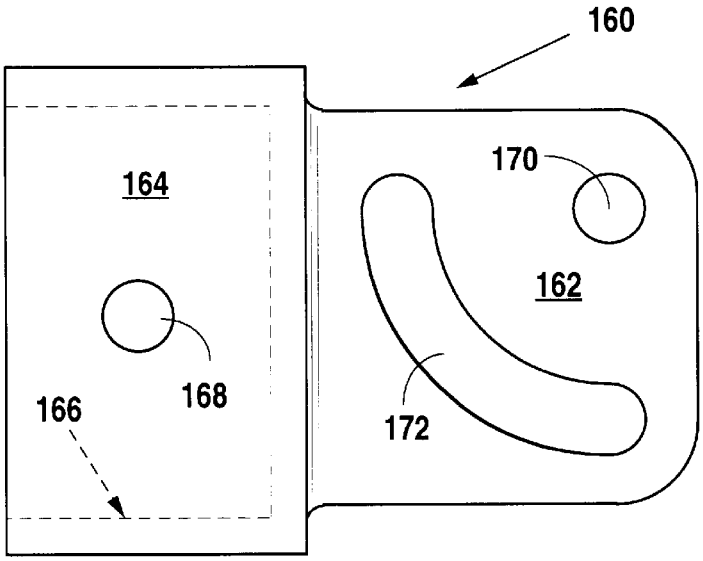
FIG. 8 discloses a side view of a pivoting end cap connector of the present invention.
Figure 9:
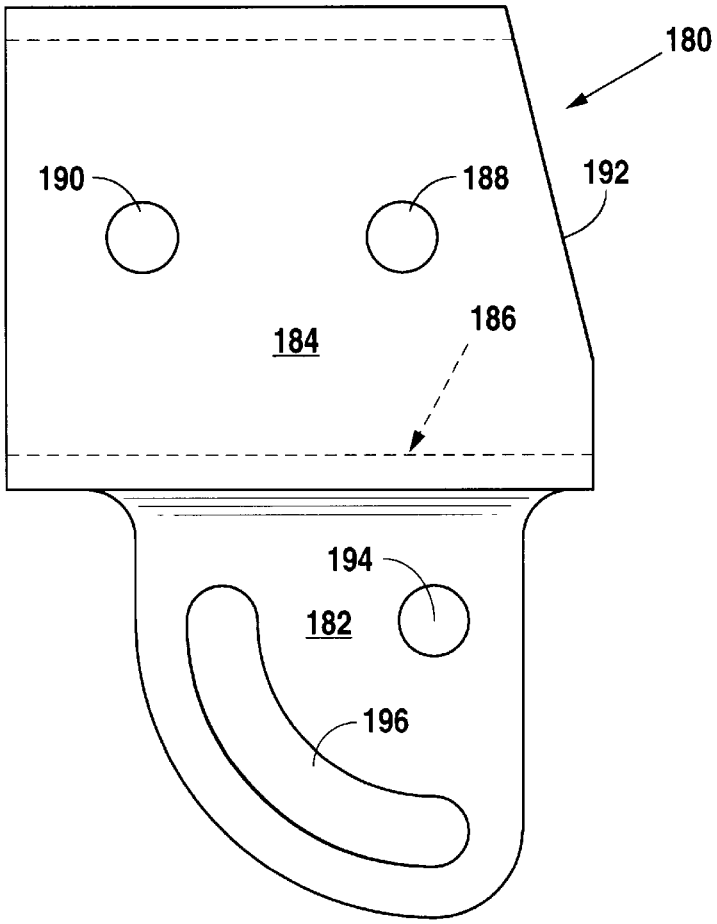
FIG. 9 discloses a side view of a pivoting in-line connector of the present invention.

Reference is now made to FIGS. 8 and 9 for two types of pivoting connectors appropriate for use in conjunction with the tubular support member of the present invention. FIG. 8 describes a pivoting end cap connector designed to fit over one end of a tubular support member. End cap (160) is comprised of pivoting plate section (162) and end cap (164). End cap (164) is a cylindrical cup-shaped section of cast aluminum with an interior wall (166). Aperture (168) is provided as a means for securing the tubular support member within end cap section (164). Pivoting plate section (162) incorporates pivot attachment aperture (170) and positioning attachment aperture (172). This arrangement permits a 90° variation in the angle for the pivotal attachment of the end cap (160). Apertures (170) and (172) may incorporate appropriate bolts, screws or the like for attachment to any of the plates and bracket sections described above. As indicated in the preferred embodiment, pivoting end cap (160) is constructed from cast aluminum and pivot plate (162) is integrally cast with cylindrical cap section (164) in a manner well-known in the art.

FIG. 9 discloses and describes a pivoting arrangement for an in-line connector for attaching two separate tubular support members end-to-end or for supporting a tubular support member at a middle section. In-line connector (180) is comprised of pivoting plate (182) and connecting cylinder (184). Apertures (188) and (190) are positioned as appropriate for securing the tubular support members within cylindrical connector section (184). Interior wall (186) has an inside diameter appropriate for insertion of the tubular support members therein. Section (184) incorporates an angled end (192) appropriate for ease of placement of tubular support member within the section (184). As with the pivoting end cap (160), pivoting plate (182) incorporates pivot attachment point (194) and 90° aperture (196).

Figure 10:
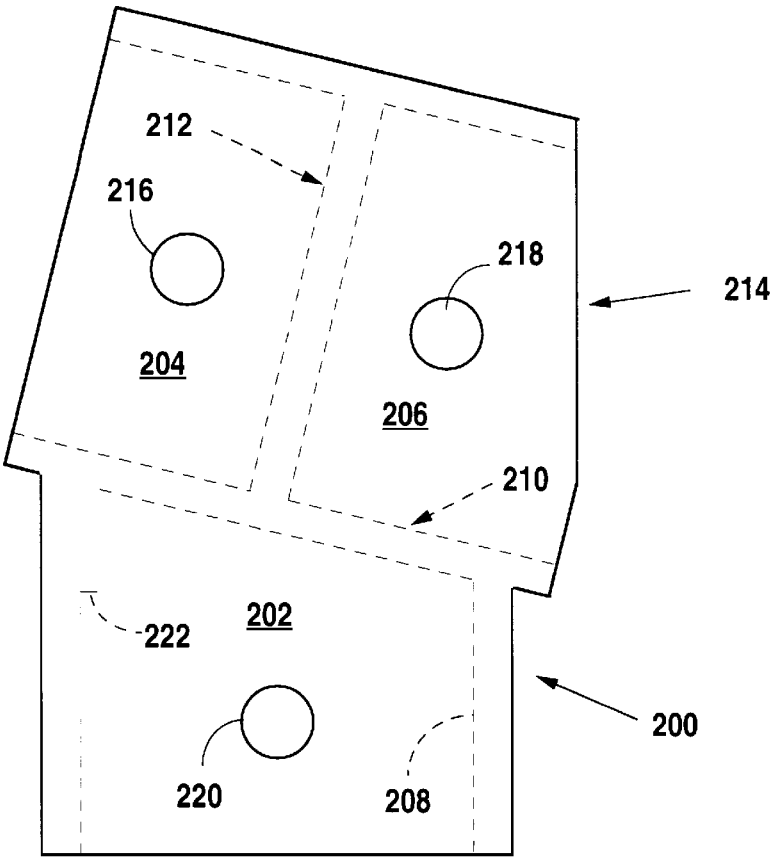
FIG. 10 discloses a side view of a 14° pitch post connector of the present invention.
Figure 11:
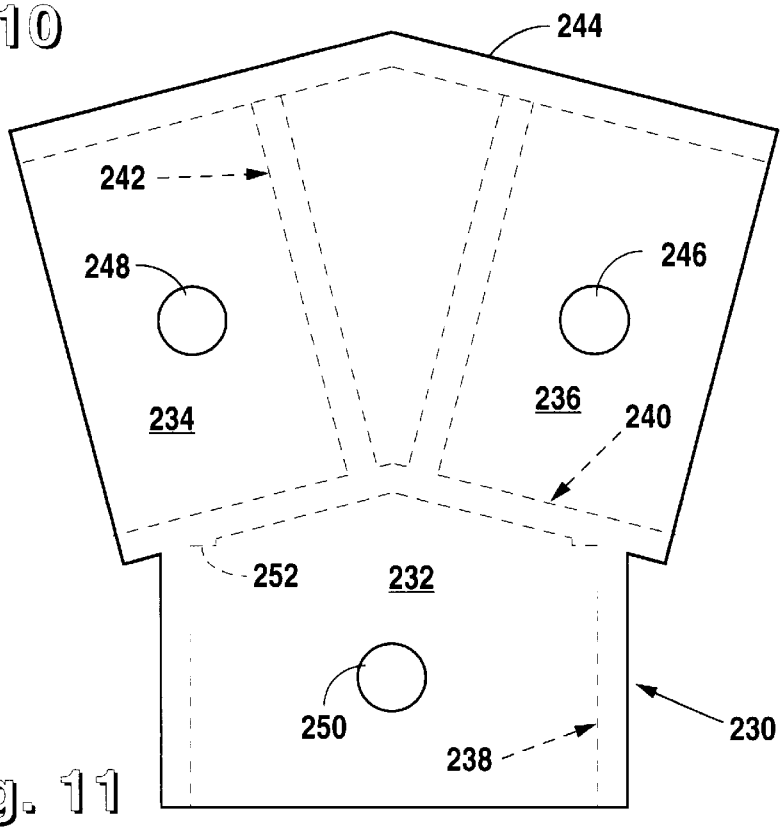
FIG. 11 discloses a side view of a peak three-post connector of the present invention.

Reference is now made to FIGS. 10 and 11 for a description of two fixed-angle post connectors of the present invention. FIG. 10 discloses a side view of a 14° pitch post connector suitable for use in conjunction with tubular support members of the present invention. 14° pitch post connector (200) incorporates means for attaching three separate tubular support members, a first in vertical post section (202), a second in riser post section (204), and a third, if necessary in lower post section (206). Vertical post connector section (202) is defined by interior diameter walls (208) and by wall stop (222), which ensures the proper positioning of the vertical tubular support member within section (202). Aperture (220) provides an appropriate means for secure attachment of the tubular support member within the connector.

Riser section (204) and optional lower section (206) are defined by walls (212) and (210), respectively. Sections (204) and (206) are generally cylindrical in structure with an outer diameter and an inner diameter appropriate for insertion of the tubular support members therein. Apertures (216) and (218) provide appropriate attachment means for securing tubular support members within the connector. As with the above described components, lower section (206) has angled wall section (214) that facilitates the insertion of tubular support member therein. Use of connector (200) is most appropriate in, for example, the edge of a roof structure where a vertical tubular support member meets rafter support members at a typical 14° angle. Additional tubular support members may or may not be utilized in lower section (206) depending upon the positioning of connector (200).

FIG. 11 describes a three-post connector appropriate for use at a peak position in a building construction framework. Peak three-post connector (230) incorporates three cylindrical compartments or sections for receipt of three separate terminal ends of tubular support members. Vertical section (232) is defined by cylindrical walls (238) and by post-stop wall (252). Aperture (250) provides an appropriate means for secure attachment.

Riser sections (234) and (236) are mirror images of each other and are positioned appropriate for the receipt of terminal peak ends of two rafter-type tubular support members. Apertures (246) and (248) provide means for securing the tubular support members within cylindrical inner diameter walls (240) and (242) as shown.

Figure 12:
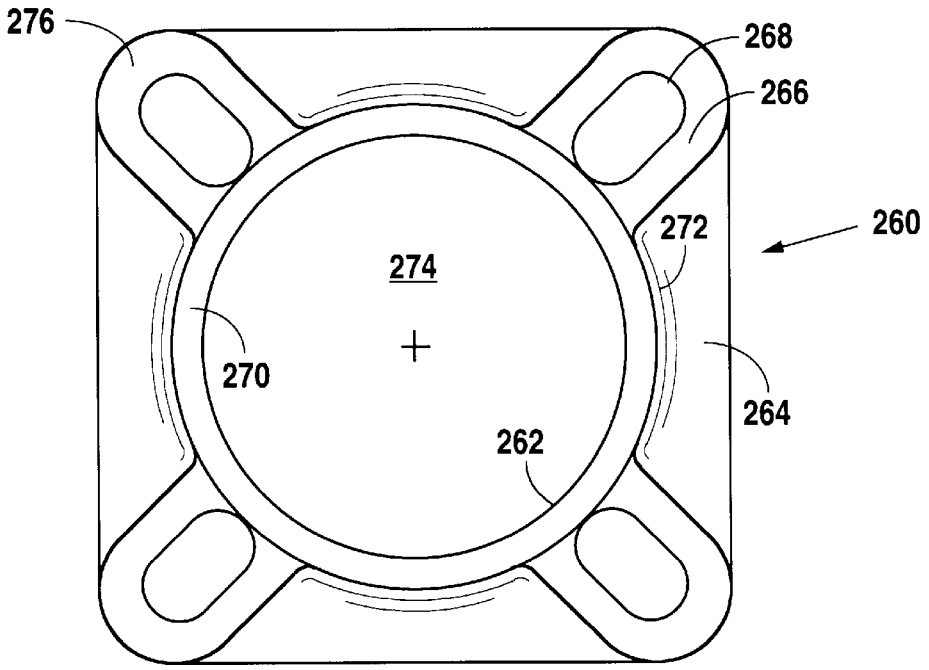
FIG. 12 discloses a cross-sectional view of a base plate adapter of the present invention.
Figure 13:
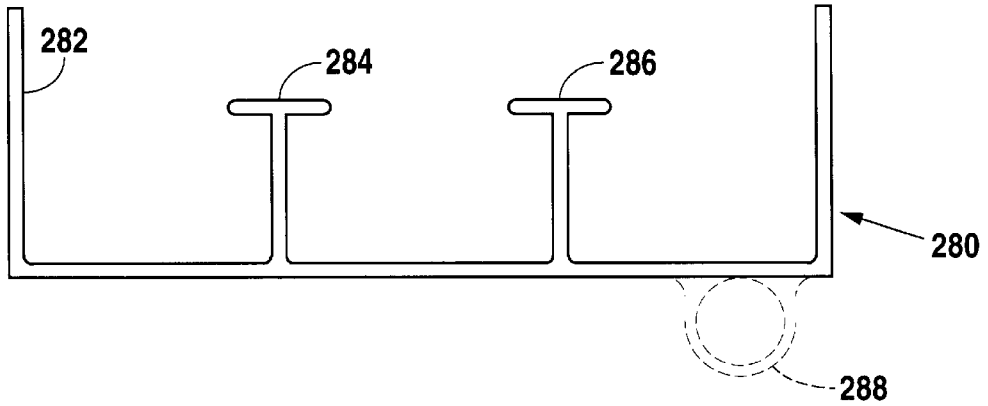

Reference is now made to FIG. 12 for a detailed description of the improved base plate adapter of the present invention. Base plate (260) comprises a generally flat rectangular plate structure with base surfaces (264) from which rises a cylindrical support structure (270). Inner diameter (262) is appropriate for acceptance of a tubular support member within the cylindrical void (274). Base plate adapter (260) is appropriate for attachment of a tubular support member to a flat foundational surface or the like. Attachment of base plate adapter (260) to the foundation structure is made by way of apertures (268) positioned at each corner within wall sections (266). Cylindrical section (270) is cast as a single piece in conjunction with base section (264) and is provided with a supporting gradient (272).

It is anticipated that a variety of dimensions are appropriate for each of the fixtures defined in the preceding description of the preferred embodiment. Just as wood and other metal-based construction components are made available in a variety of dimensions depending upon the particular applications of concern, the improved components of the present invention are anticipated as being constructed in a number of standard dimensions. In general, the diameter of the tubular support member that forms the basis of the present invention would be sized to dimensions appropriate for constructing walls of thicknesses standard in the building industry. Thus, dimensions anywhere from one inch to twelve inches are appropriate for the diameter of the tubular support member. The various other brackets, components, and attachments described herein would thereby have dimensions defined according to the basic diameter dimension of the tubular support member.

I claim:

1. A structural building component suitable for use in conjunction with a variety of attachments and connecting devices, said component comprising:

an elongate tubular member having a major longitudinal central axis, said member comprising an outer shell centered on said central axis and defining a periphery that includes at least one longitudinal groove therein, said groove being disposed substantially parallel to said major longitudinal central axis;

said groove having an arcuate side wall portion and a substantially flat side wall portion;

said groove further having a flat base wall portion disposed in a plane substantially perpendicular to a radius emanating from said major longitudinal central axis;

said tubular member further comprising an inner shell substantially cylindrical in cross section, said inner shell positioned within said outer shell and centered on said central axis, said inner shell integral with said outer shell at a position on said outer shell adjacent said base wall portion of said groove, said inner shell and said outer shell defining a plurality of longitudinal voids between said shells.

2. A system of structural metallic building components suitable for connection and attachment to each other and to a variety of standard building components, said system comprising:

at least two elongate tubular members, said tubular members each having a major longitudinal central axis, said members each comprising an outer shell centered on said central axis and defining a periphery that includes at least one longitudinal groove therein, said groove being disposed substantially parallel to said major longitudinal central axis;

said groove having an arcuate side wall portion and a substantially flat side wall portion;

said groove further having a flat base wall portion disposed in a plane substantially perpendicular to a radius emanating from said major longitudinal central axis;

each of said tubular members further comprising an inner shell substantially cylindrical in cross section, said inner shell positioned within said outer shell and centered on said central axis, said inner shell integral with said outer shell at a position on said outer shell adjacent said base wall portion of said groove, said inner shell and said outer shell defining a plurality of longitudinal voids between said shells;

at least one connecting component for securely joining a first of said elongate tubular members to a second of said tubular members.

3. The system of claim 2 wherein said connecting component comprises a pivoting in-line connector having a cylindrical shell for receiving and securing said first and said second tubular members and further having a pivoting plate attached to said cylindrical shell for securing said connector to a fixed support structure.

4. The system of claim 2 wherein said connecting component comprises a fixed angle connector having a cylindrical shell for receiving and securing end sections of said first and said second tubular members at a fixed angle to each other.

5. A system of structural metallic building components suitable for connection and attachment to each other and to a variety of standard components, said system comprising:

at least one elongate tubular member, said tubular member having a major longitudinal central axis, said member comprising and outer shell centered on said central axis and defining a periphery that includes at least one longitudinal groove therein, said groove being disposed substantially parallel to said major longitudinal central axis;

said groove having an arcuate side wall portion and substantially flat side wall portion;

said groove further having a flat base wall portion disposed in a plane substantially perpendicular to a radius emanating from said major longitudinal central axis;

said tubular member further comprising an inner shell substantially cylindrical in cross section, said inner shell positioned within said outer shell and centered on said central axis, said inner shell integral with said outer shell at a position on said outer shell adjacent said base wall portion of said groove, said inner shell and said outer shell defining a plurality of longitudinal voids between said shells;

at least one connecting component for securely joining said elongate tubular member to a fixes external support structure.

6. The system of claim 5 wherein said connecting component comprises a pivoting end-cap connector having a cylindrical shell for receiving and securing an end section of said tubular member and further having a pivoting plate attached to said cylindrical shell for securing said connector to a fixed support structure.

7. The system of claim 5 wherein said connecting component comprises a base plate connector having a cylindrical shell for receiving and securing an end section of said tubular member and further having a substantially flat plate orthogonally attached to said cylindrical shell for securing said base plate connector to a horizontal, planar surface.

8. A system of structural metallic building components suitable for connection and attachment to each other and to a variety of standard building components, said system comprising:

at least three elongate tubular members, said tubular members each having a major longitudinal central axis, said members comprising an outer shell centered on said central axis and defining a periphery that includes at least one longitudinal groove therein, said groove being disposed substantially parallel to said major longitudinal central axis;

said groove having an arcuate side wall portion and a substantially flat side wall portion;

said groove further having a flat base wall portion disposed in a plane substantially perpendicular to a radius emanating from said major longitudinal central;

each of said tubular members further comprising an inner shell substantially cylindrical in cross section, said inner shell positioned within said outer shell and centered on said central axis, said inner shell integral with said outer shell at a position on said outer shell adjacent said base wall portion of said groove, said inner shell and said outer shell defining a plurality of longitudinal voids between said shells;

at least one connecting component for securely joining a first of said elongate tubular members to a second and a third of said tubular members.

9. The system of claim 8 wherein said connecting component comprises a fixed angle connector having a cylindrical shell for receiving and securing end sections of said first, said second, and said third tubular members at a fixed angle to each other, said fixed angle suitable for defining a fixed peak junction of said three tubular support members.

10. The system of claim 8 wherein said connecting component comprises a fixed angle connector having a cylindrical shell for receiving and securing end sections of said first and said second tubular members in line with each other and at a fixed angle with respect to said third tubular member.

11. A system of structural metallic building components suitable for connection and attachment to each other and to a variety of standard building components, said system comprising:

at least one elongate tubular member, said tubular member having a major longitudinal central axis, said member comprising an outer shell centered on said central axis and defining a periphery that includes at least one longitudinal groove therein, said groove being disposed substantially parallel to said major longitudinal central axis;

said groove having an arcuate side wall portion and a substantially flat side wall portion;

said groove further having a flat base wall portion disposed in a plane substantially perpendicular to a radius emanating from said major longitudinal central axis;

said tubular member further comprising an inner shell substantially cylindrical in cross section, said inner shell positioned within said outer shell and centered on said central axis, said inner shell integral with said outer shell at a position on said outer shell adjacent said base wall portion of said groove, said inner shell and said outer shell defining a plurality of longitudinal voids between said shells;

at least one bracket component for securely joining an external fixture to said elongate tubular member.

12. The system of claim 11 wherein said bracket component is configured for mating with and interconnecting with said elongate support member by insertion into said longitudinal groove, said bracket component having a portion thereof provided with an arcuate shape which is configured and dimensioned to conform to and fit within said arcuate wall portion of said groove, said bracket component further comprising a single plate extension directed radially outward from said tubular member.

13. The system of claim 11 wherein said bracket component is configured for mating with and interconnecting with said elongate support member by insertion into said longitudinal groove, said bracket component having a portion thereof provided with an arcuate shape which is configured and dimensioned to conform to and fit within said arcuate wall portion of said groove, said bracket component further comprising a double plate extension directed radially outward from said tubular member, said double plate extension defining a slot.

14. The system of claim 11 wherein said bracket component is configured for circumfrential attachment to said elongate support member, said bracket component having a cylindrical wall portion which is configured and dimensioned to conform to and fit around said tubular member, said bracket component further comprising means for clamping said cylindrical wall portion securely to said tubular member, said bracket component further having a plurality of plate extensions directed tangentially outward from said tubular member.

15. The system of claim 14 wherein said plurality of plate extensions are positioned in parallel.

16. The system of claim 14 wherein said plurality of plate extensions are positioned orthogonally.

* * * * *